US005365718A

United States Patent [19]

Schott

[11] Patent Number: 5,365,718

[45] Date of Patent: Nov. 22, 1994

[54] METHOD AND APPARATUS FOR CLOSING BOTTLE-LIKE CONTAINERS WITH A CAPSULE

[75] Inventor: Helmut Schott, Satteldorf, Germany

[73] Assignee: Robert Bosch GmbH, Stuttgart, Germany

[21] Appl. No.: 30,961

[22] Filed: Mar. 12, 1993

[30] Foreign Application Priority Data

Mar. 18, 1992 [DE] Germany ..... 4208666

[51] Int. Cl.[5] ..... B67B 3/14; B65B 7/28

[52] U.S. Cl. ..... 53/202; 53/351; 53/353

[58] Field of Search ..... 53/488, 346, 344, 353, 53/351, 202

[56] References Cited

U.S. PATENT DOCUMENTS

| | | | |
|---|---|---|---|
| 2,112,842 | 4/1938 | Hogg | 226/85 |
| 2,129,359 | 9/1938 | Pommer | 226/85 |
| 2,339,119 | 1/1944 | Thomas | 53/488 |
| 2,643,805 | 6/1953 | Muller-Strobel | 53/351 |
| 2,891,366 | 6/1959 | Stover | 53/361 |
| 3,075,331 | 1/1963 | Stanley | 53/353 |
| 3,163,973 | 1/1965 | St. Clair | 53/488 X |
| 3,422,598 | 1/1969 | Shields | 53/488 X |
| 3,460,311 | 8/1969 | Koll et al. | 53/488 |
| 4,173,104 | 11/1979 | Koll | 53/351 X |
| 4,674,266 | 6/1987 | Araki | 53/202 X |

FOREIGN PATENT DOCUMENTS 3908582 1/1991 Germany ..... B67B 3/02

*Primary Examiner*—Horace M. Culver

*Attorney, Agent, or Firm*—Edwin E. Griegg; Ronald E. Griegg

[57] ABSTRACT

Bottles are closed with capsules whose free end segment is crimped over the top of the bottles. To avoid abrasion and turbulence, the end segment of the cap is deformed by a simultaneous, uniform upsetting of its entire circumference in a female die. An apparatus for carrying out the invention has a female die that is split into two parts, with cylindrical bores and with a constricting rib on a bottom portion which fits around the neck of the bottles. The rib has a concavely rounded side upon which the end segment of the cap, is thrust against and is deflected toward the bottle. The female die is split into two jaws that can be pivoted toward one another and whose opening and closing motion is coupled to the motion of an axially displacable male dies that displace the capsules in the female die for sealing the capsules onto the bottle.

9 Claims, 6 Drawing Sheets

METHOD AND APPARATUS FOR CLOSING BOTTLE-LIKE CONTAINERS WITH A CAPSULE

BACKGROUND OF THE INVENTION

The invention is based on an apparatus for closing containers, such as bottles, as defined hereinafter. In an apparatus of this kind, known for instance from DE-OS 39 08 582, the end segment of the jacket of the capsule, pressed onto the top of the bottle by a male die, is crimped around the neck of the bottle continuously by rotation of the bottle with the capsule against a fixed disk -with point-type contact. In another, one or more crimping rollers circle around the capsule and by rolling along it again gradually crimp the end portion of the capsule jacket around the top of the bottle, again with point-type contact. A disadvantage of this known apparatus is that the engagement of this crimping tool produces abrasion in the course of rotation; such abrasion must be avoided, particularly when packaging pharmaceuticals. An apparatus that meets the demands for cleanliness of the surrounding atmosphere in the field of pharmaceuticals is therefore desirable.

OBJECT AND SUMMARY OF THE INVENTION

The apparatus according to the invention has an advantage that capsules, which are preferentially of aluminum, can be secured to bottles with very little abrasion. Moreover, because of the absence of rotation of the containers and/or contact rollers, no turbulence is created in either the product in the containers or in the ambient atmosphere. Moreover, since there is no circumferential friction between the capsule and the bottle, an uneven deformation of the capsule that would impair sealing does not occur either. Capsules set crookedly on the top of a bottle are axially straightened in the closing process by the simultaneous, annular engagement of the female die.

An apparatus according to the invention for carrying out the invention has the advantage that the flow of force brought to bear, during reshaping of the capsule, between the opening edge and the side of the lip at the top of the bottle near the neck makes a closed form within the capsule itself, so that no pressure strain arises in the bottle, except for the sealing contact force.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
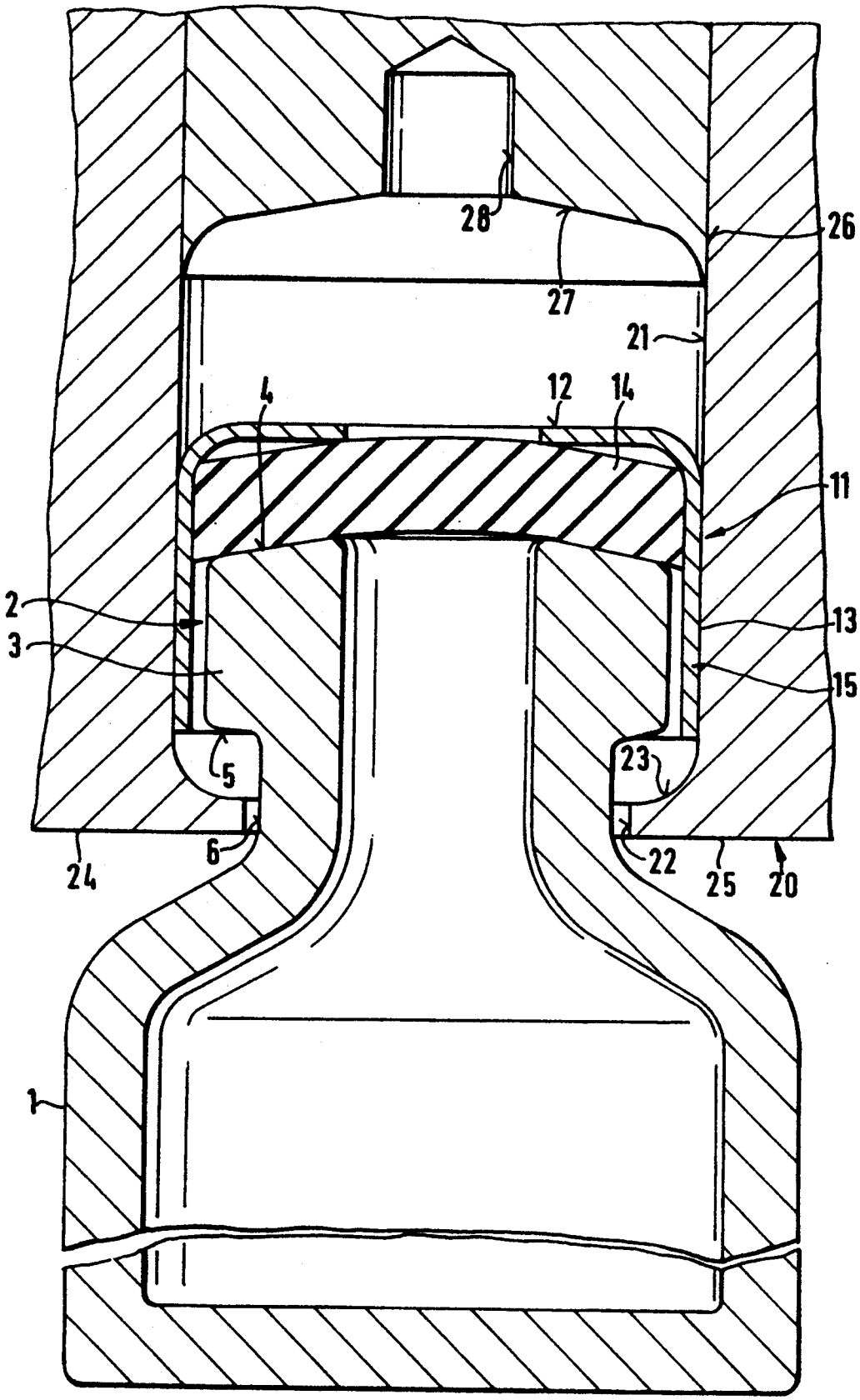
FIGS. 1 and 2 show a bottle with a capsule in two different phases of being processed, greatly enlarged and in cross section.

Bottles 1, which have a top 2 with a lip 3, an opening edge 4, and a side 5 dropping away to the neck 6, are closed with a cap-like capsule 11, which on a flat top part 12 has a cylindrical jacket 13 and an elastic sealing insert 14. The capsules 11 are secured to the bottle 1 by crimping of the free end segment 15 onto the side 5 of the lip 3, whereupon the capsule 11 is acted upon by a predetermined force pressing the elastic sealing insert 14 onto the opening edge 4 of the bottle 1. To that end, a capsule 11 is first placed loosely on the top 2 of the bottle 1. The top 2 of the bottle 1, with the capsule 11 placed on it, is put into a female die 20, which has a cylindrical bore 21 adapted to the circumference of the capsule 11 and an annular rib 22 radially constricting the opening of the bore 21, so that the bore 21 fits around the capsule 11 with little play and the annular rib 22 fits around the neck 6 of the bottle 1 with pronounced play. The side 23 forming the transition from the cylindrical bore 21 to the annular rib 22 is rounded in concave fashion. It may also be embodied as an annular groove with a curved cross section. The female die 20 is split, to make it possible to introduce the top 2 of the bottle 1 along with the capsule 11, whose diameter is larger than the inside diameter of the annular rib 22, into the cylindrical bore 21. The female die is preferably formed of two jaws 24, 25 that can be pivoted relative to one another. A male pressing die 26 is axially displacable with little play in the cylindrical bore 21, and its face end is formed by a recess 27, adapted to the final shape of the top part 12 of the capsule 11 and by a centering bore 28.

Figure 2:
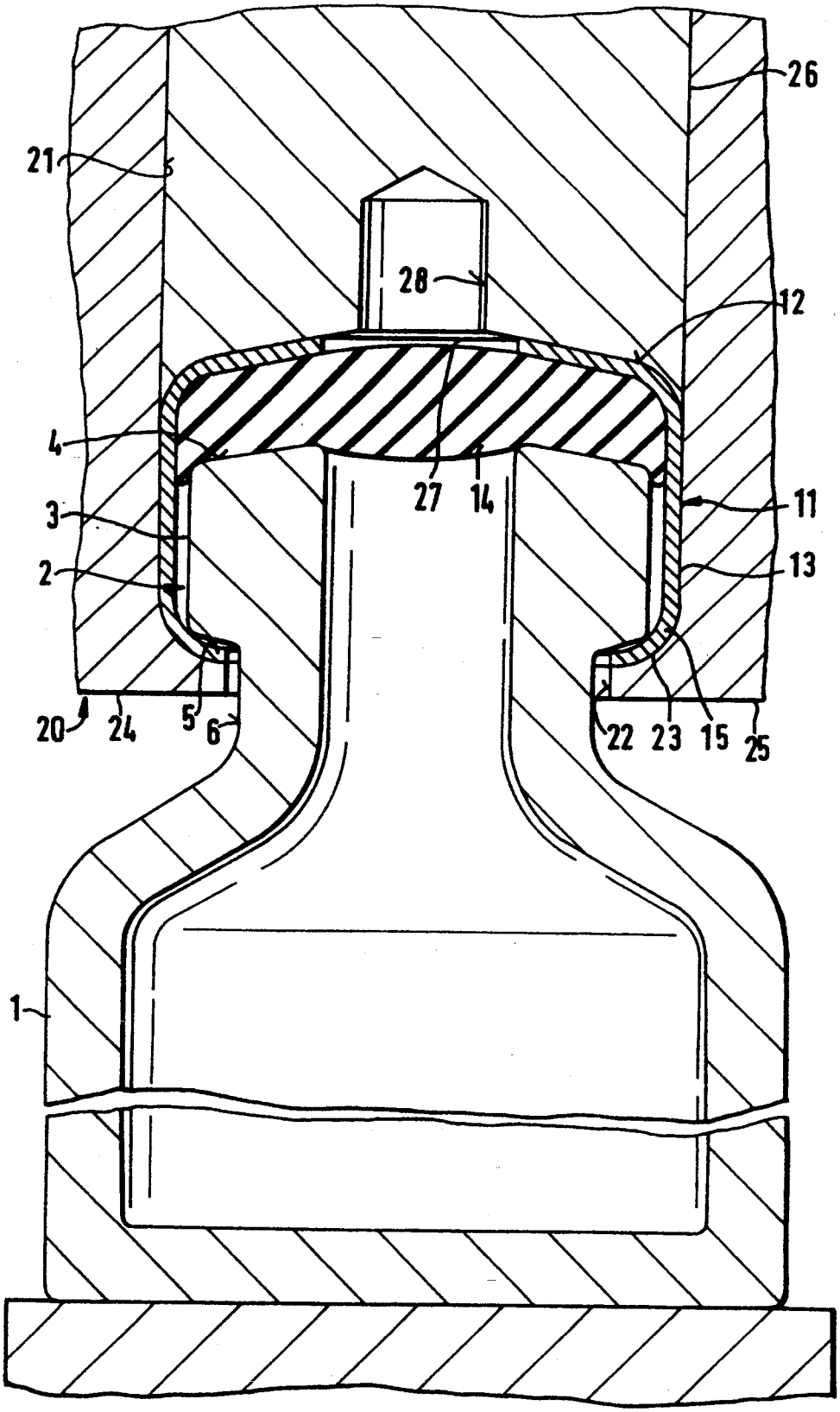

Once the top 2 of the bottle 1, with the cap 11 placed on it, has been placed in the vicinity of the bore 21 of the spread-apart jaws 24, 25 of the female die 20 and the top 2 with the capsule 11 has been enclosed in the cylindrical bore 21 by the movement toward one another of the two jaws 24, 25 (FIG. 1), the male die 26 is moved in the direction of the annular rib 22. In this process, resting on the top part 12 of the capsule and in particular on its radially outer region, the male die presses the capsule 11 against the annular rib 22 of the matrix 20. First the free edge and then the end segment 15 of the jacket 13 of the capsule 11 is deflected toward the longitudinal axis along the radially inwardly protruding rounded side having a concave annular face 23 of the annular rib 22 in this process, whereupon the material of the end segment 15 is crimped in the region of its entire circumference, simultaneously and uniformly, by being upset around the side 5 of the lip 3 of the bottle top 2 (FIG. 2). In the final phase of this reshaping process, the male die 26 also presses the sealing insert 14 on the opening edge 4 of the bottle top 2, so that once the male die 26 has been retracted to its outset position and the two jaws 24, 25 have been moved apart, the capsule 11 with its crimped end segment 15 keeps the sealing insert 14 pressed tightly against the opening edge 4 of the bottle 1.

Upon deformation of the end segment 15 of the capsule 11, the flow of force between the male die 26 and the female die 20 in the capsule 11 is closed without straining the bottle 1. Only the closing pressure upon the sealing insert 14 is transmitted via the supported bottle 1.

Figure 3:
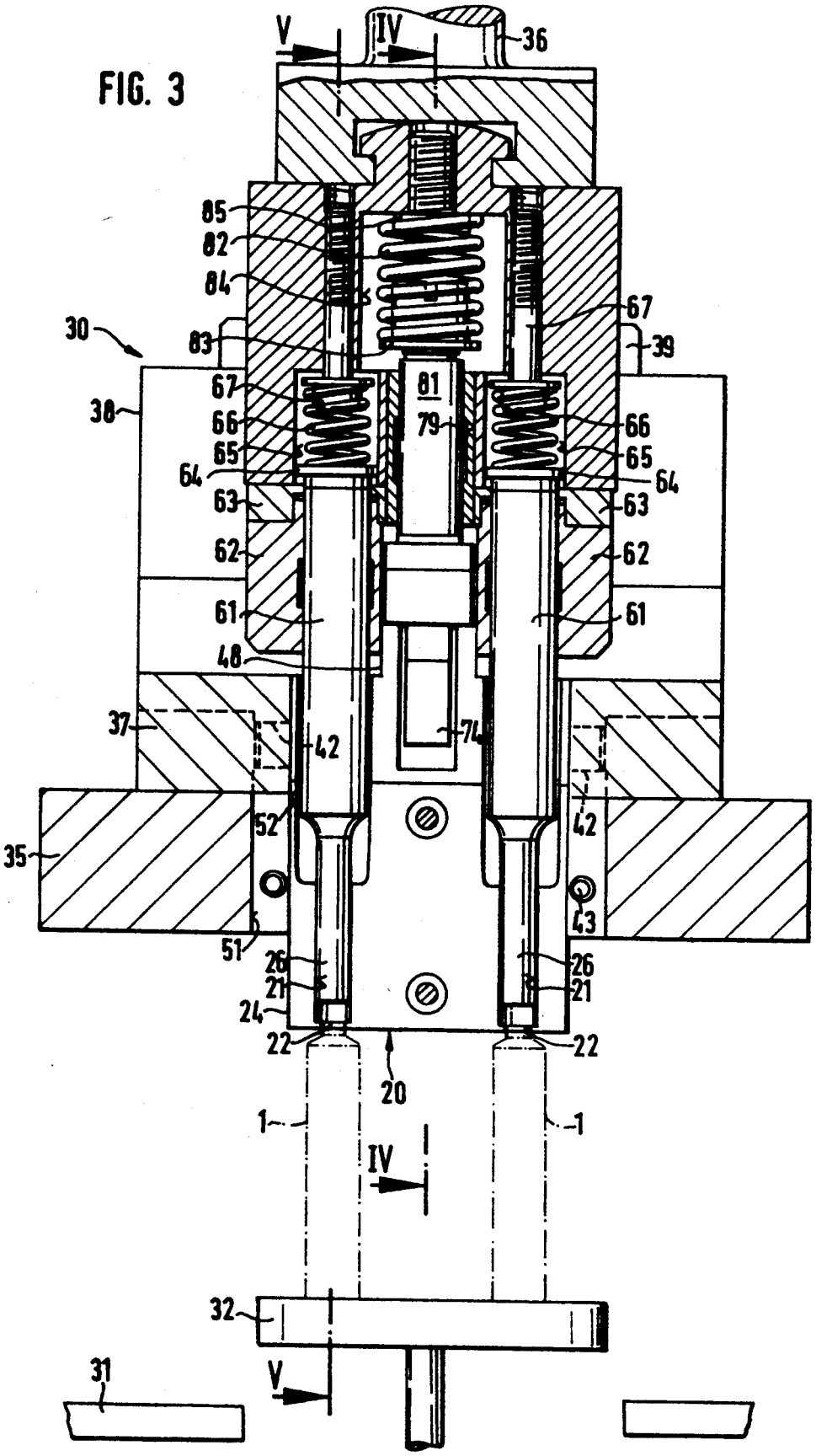
FIG. 3 is a longitudinal section through an apparatus for closing two bottles at a time.

An apparatus for carrying out the above-described closing method is embodied for closing two bottles at a time (FIG. 3). The bottles 1 are brought in pairs to the apparatus 30 with a conveyor system 31, not shown in detail; with a platform 32, they are raised to the closing position and lowered again after closure. It is also possible for them to be introduced between the spread jaws and removed from them again at the working level and in the plane separating the jaws 24, 25, so that a raisable and lowerable platform can then be dispensed with.

The closing apparatus is actuated by a press of the type available on the market, with a stationary table 35 and a male pressing die 36 movable up and down counter to it. It has a base plate 37 secured to the table 35 and a top 38 firmly coupled to the male pressing die 36 that is guided vertically counter to the base plate along guide bars 39.

Figure 4:
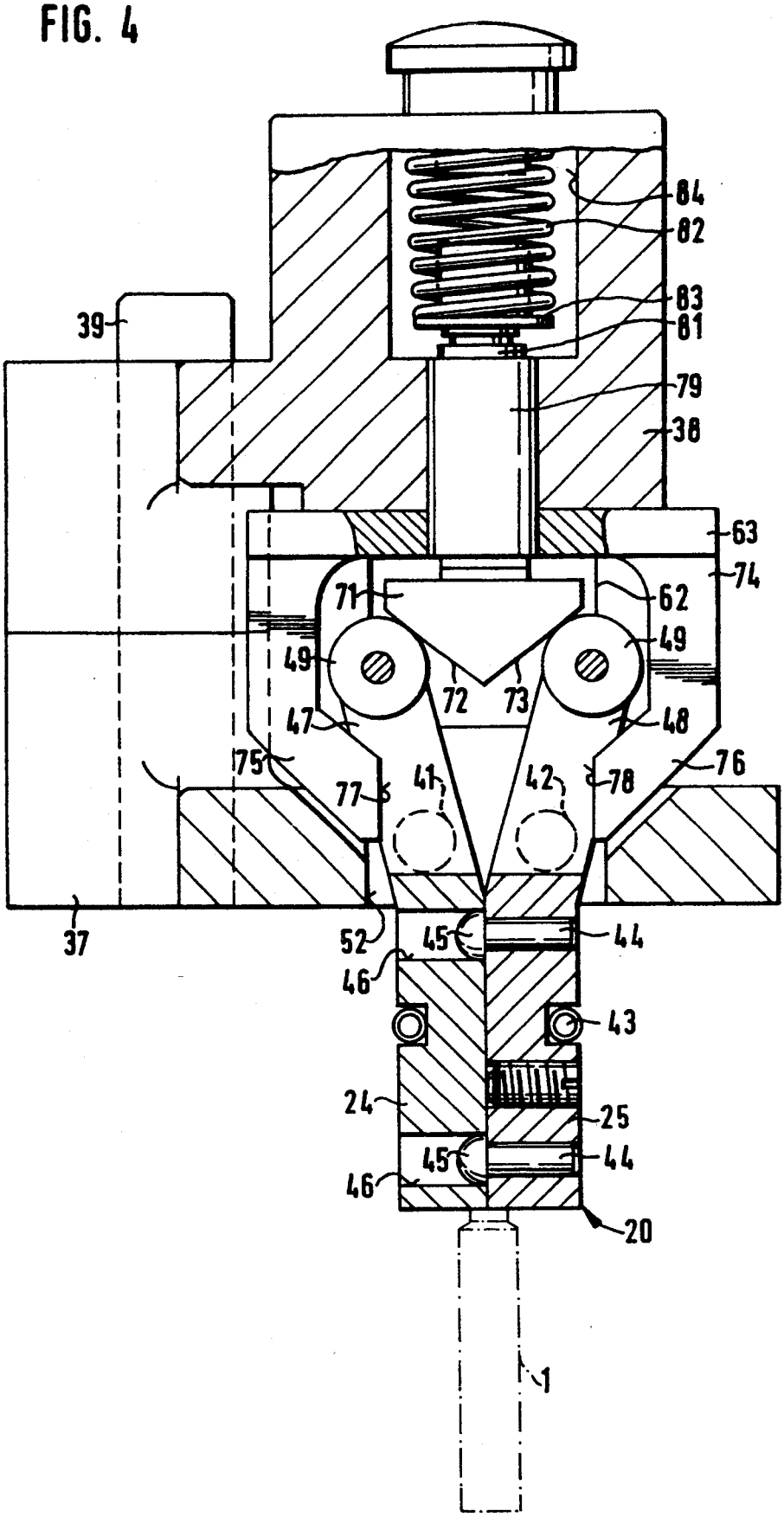
FIG. 4 is a cross-sectional view along the plane IV—IV of FIG. 1 of the apparatus of FIG. 3.
Figure 5:
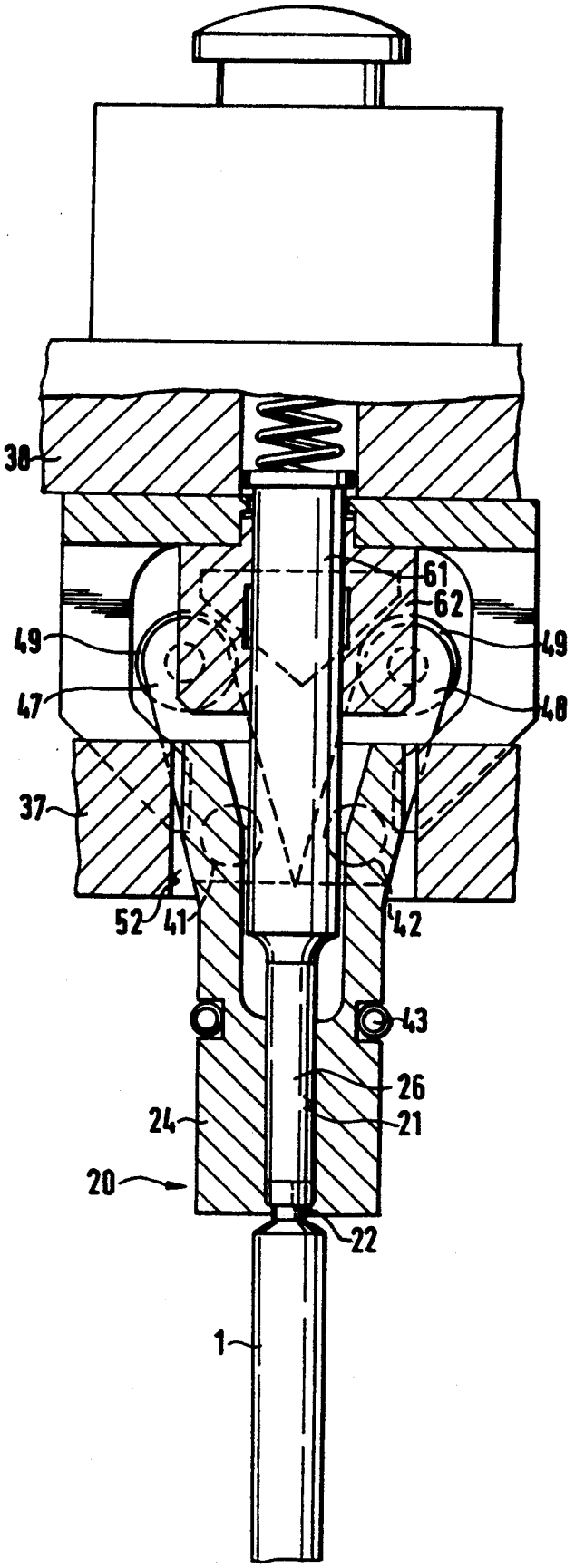
FIGS. 5 and 6 are cross-sectional views of the apparatus of FIG. 1 in the plane V—V of FIG. 1 in two different work positions.
Figure 6:
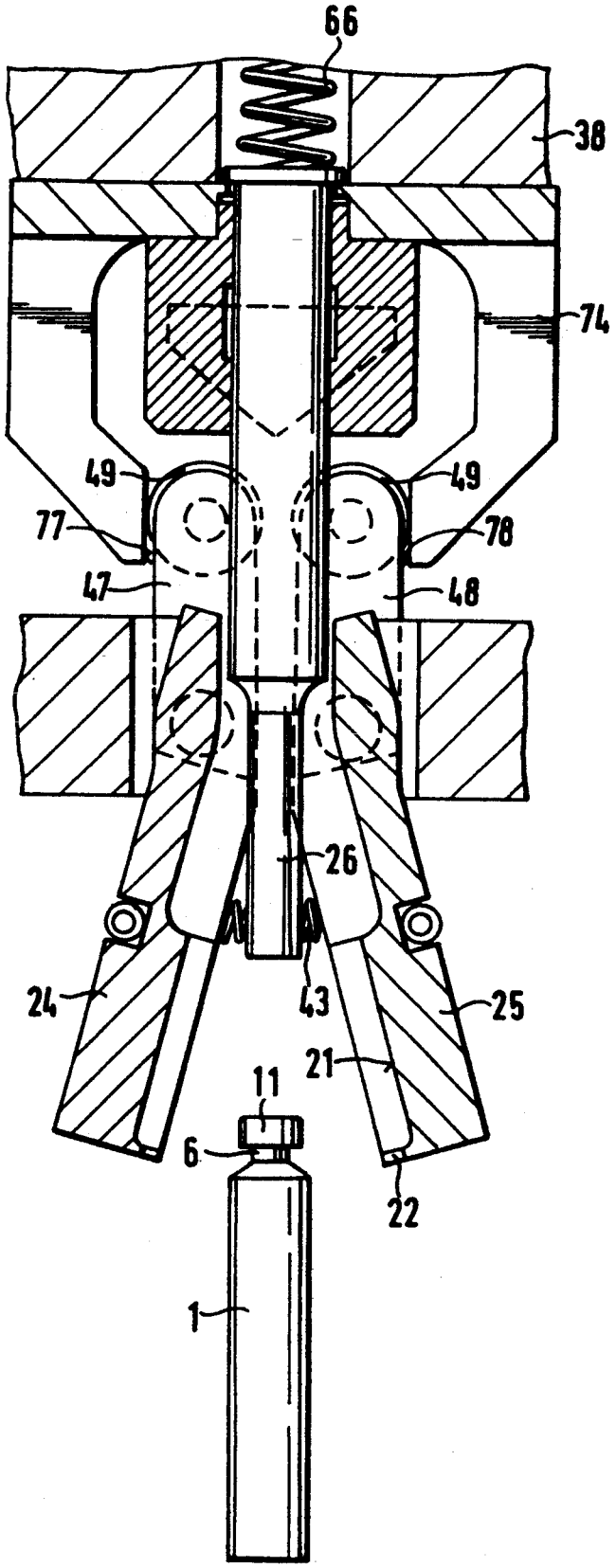

To produce a seal for each of two bottles 1, the two jaws 24, 25 forming the female die 20 have two parallel cylindrical bores 21. They are pivotably supported in the base plate 37 on tangs 41, 42 about axes that extend near the longitudinal axis of the cylindrical bores 21 and transversely to them in the end region of the jaws 24, 25 that is located opposite the end region having the annular ribs 22 of the cylindrical bores 21. An annular spring 43 pulls the two jaws 24, 25 together. In the closing position, they are aligned by two centering pins 44, which plug into one jaw 25 and with their semicircular head 45 engage the coaxial aligning bores 46 in the other jaw 24 (FIG. 4). For pivoting the two jaws 24, 25 whose ends with the annular rib 22 protrude downward through recesses 51, 52 in the base plate 37 and in the table 35, the opposite upper end is each adjoined by a respective slightly angled pair of levers 47, 48, each having a roller 49. By swiveling the pairs of levers 47, 48 with the roller 49, the jaws 24, 25 are pivoted toward and away from one another, and the female die 20 is closed and opened (FIGS. 5 and 6).

The male dies 26, which are displacable in the cylindrical bores 21 of the female die 20 and which have a thickened shaft 61 above the bores 21, are moved up and down with the head 38. They are displaceably guided in blocks 62, which are secured, with the interposition of a plate 63, to the underside of the head 38. Their upper end has a collar 64 that protrudes into a blind bore 65 in the head 38. A compression spring 66, which is supported at the bottom of the blind bore on a set screw 67, assures that the capsule 11 will be pressed against the top 2 of a bottle 1 resiliently.

The head 38 which is movable up and down also carries the actuation elements for moving the jaws 24, 25 together and apart. These elements are a truncated wedge 71, which has oblique surfaces 72, 73 and points downward and is disposed in the region of the roller 49 of the pair of levers 47, 48, and a fork 74 having two arms 75, 76 pointing downward and fitting around the part 1 with clearance. The ends of the arms 75, 76 are oriented toward one another and have faces 77, 78 that are parallel to the axis of motion of the head 38 with the male dies 26. The arms 75, 76 are mounted on the plate 63, which is centered in the head 38 with a sheath 79. A tang 81 that carries the wedge 71 is limitedly displacable in the sheath 79 and is pressed downward by a hard compression spring 82 in a blind bore 84 in the head 38 against a collar 83, which is supported against a set screw 85 in the bottom of the blind bore 84.

The closing apparatus described functions follows:

With the female die 20 open, in other words if the jaws 24, 25 have been pivoted apart, two bottles 1 with capsules 11 placed on them are raised in an upright position by the platform 32 to the closing position, so that their neck 6 is located at the level of the annular rib 22 and the head 2 with capsule 11 is located in the region of the cylindrical bore 21 (FIG. 6). The jaws 24, 25 are pivoted into this open position by the head 38, which has been raised to its upper terminal position. Also in this position, the male dies 26 have been drawn upward, and the rollers 49 of the pairs of levers 47, 48 rest on the inner vertical sides 77, 78 of the two arms 75, 76 of the fork 74, under the influence of the annular spring 43. Once two bottles 1 with capsules 11 have been positioned in the closing position, the head 38 is moved downward by the male pressing die 36. In this process, the rollers 49 run from the vertical faces 77, 78 onto the oblique faces 79, 80 of the inside of the arms 75, 76 of the fork 74, so that the jaws 24, 25 pivot toward one another under the influence of the annular spring 43. In the ensuing main phase of the lowering motion of the head 38, the oblique faces 72, 73 of the wedge 71 come to contact the rollers 49 of the pairs of levers 47, 48. The pressure transmitted to the wedge 71 by the head 38 via the compression spring 82 and the tang 81 pivots the two pairs of levers 47, 48 apart about the pivot axis of the tangs 41, 42 and in this process presses the jaws 24, 25 firmly together. The male dies 26 move downward in the bores 21, in which process, as already noted above, they slide the caps 11 against the rib 22 so that the end segment 15 of the jacket 13 of each cap 11 is crimped around the top 2 of each bottle 1.

In the ensuing reverse stroke of the pressing head 38, the male dies 26 are pulled upward again and the rollers 49 come to rest on the oblique faces 79, 80 and roll down along them to the vertical faces 77, 78 of the arms 75, 76 of the fork 74, in the course of which the jaws 24, 25 are pivoted apart again counter to the force of the annular spring 43. The closed bottles are now removed, and others with caps 11 placed on them are put in position.

It should be noted in addition that the female die can be split not only into two halves as in the exemplary embodiment described above, but into more than two parts as well. The exemplary embodiment has the particular advantage that because the pivot axis of the two jaws forming the female die is located as close as possible to the plane separating them and transversely to that, precise function of the split female die is created.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the U.S. is:

1. An apparatus for securing a closure cap having a depending cylindrical jacket onto a top portion of a bottle, which comprises, a female die (20), a bore (21) in said female die, a male die movable in said bore against a top portion of said closure cap that presses the top portion of the cap against the top of the bottle supported on a support, said female die having an annular rib (22) on a bottom portion thereof oriented radially inward, said annular rib has a concave side (23) adjoining a cylindrical guide (21), and that the male die (26) is axially displacable toward the annular rib (22) in the guide (21), said female die (20) is divided into two parts and the two parts (24, 25) are oriented for closing toward one another to secure said bottle in place and operable relative to each other for removal of said bottle subsequent to being capped, said female die (20) is split into two halves embodied as jaws (2345, 25) which are pivotably supported about parallel tangs (41, 42), which tangs extend transversely to an axial direction of an axis of the cylindrical guide (21) of the female die

(20) and are located in a region of an upper end of the female die, the jaws (24, 25) have levers (47, 48) which cooperate with control faces (72, 73; 77, 78 and 79, 80) for swiveling the jaws.

2. An apparatus as defined by claim 1, in which the control faces (72, 73; 77, 78 and 79, 80) are disposed on a raisable and lowerable pressing head (38) that carries the male die (26) and is displacable axially parallel to the alignment of the axis of the cylindrical bore (21) of the female die (20).

3. An apparatus as defined in claim 2, in which the male die (26) is resiliently disposed in the pressing head (38).

4. An apparatus for securing a closure cap having a depending cylindrical jacket onto a top portion of a bottle, which comprises a pair of female dies (20), each of said pair of female dies is formed with two jaws (24, 25) which are moved apart to receive a bottle to be capped and moved together for capping the bottles, a bore (21) in each said female die, a pressing head (38) including two parallel male dies (21) aligned with each said bore, said pressing head including movable faces (72, 73; 77, 78 and 79, 80) disposed between the parallel male dies for swiveling the jaws (24, 25), a male die movable in each said bore against a top portion of said closure cap that presses the top portion of the closure cap against the top of the bottle supported on a support, each said female die having an annular rib (22) on a bottom portion thereof oriented radially inward, said annular rib has a concave side (23) adjoining a cylindrical guide (21), and that the male die (26) is axially displacable toward the annular rib (22) in the guide (21).

5. An apparatus as defined by claim 4, in which the two pivotable jaws (24, 25) of said female die (20) are oriented for closing toward one another to secure said bottle in place and operable relative to each other for removal of said bottle subsequent to being capped.

6. An apparatus as defined by claim 5, in which the female die (20) is split into two halves embodied as jaws (24, 25) which are pivotably supported about parallel tangs (41, 42), which tangs extend transversely to an axial direction of an axis of the cylindrical guide (21) of the female die (20) and are located in a region of an upper end of the female die.

7. An apparatus as defined by claim 6, in which the jaws (24, 25) have levers (47, 48) which cooperate with control faces (72, 73; 77, 78 and 79, 80) for swiveling the jaws.

8. An apparatus as defined by claim 7, in which the control faces (721, 73; 77, 78 and 79, 80) are disposed on a raisable and lowerable pressing head (38) that carries the male die (26) and is displacable axially parallel to the alignment of the axis of the cylindrical bore (21) of the female die (20).

9. An apparatus as defined in claim 8, in which the male die (26) is resiliently disposed in the pressing head (38).

* * * * *